United States Patent [19]

Lair et al.

[11] Patent Number: 4,522,356

[45] Date of Patent: Jun. 11, 1985

[54] MULTIPLE TARGET SEEKING CLUSTERED MUNITION AND SYSTEM

[75] Inventors: Clair K. Lair, Upland; Jules Jonas, Claremont; Keith D. Anderson, Upland, all of Calif.

[73] Assignee: General Dynamics, Pomona Division, Pomona, Calif.

[21] Appl. No.: 415,452

[22] Filed: Nov. 12, 1973

[51] Int. Cl.[3] ..... F41G 7/22; F42G 13/32

[52] U.S. Cl. ..... 244/3.15; 102/489; 244/3.28

[58] Field of Search ..... 102/2, 3, 7.2, 384, 102/393, 489; 244/3.16, 3.28, 3.29, 3.15; 343/7; 89/1.5 C

[56] References Cited

U.S. PATENT DOCUMENTS

| | | | |
|---|---|---|---|
| 2,450,910 | 10/1948 | O'Rear | 102/7.2 |
| 2,585,030 | 2/1952 | Nosker | 89/1.5 C |
| 2,951,658 | 9/1960 | Jones, Jr. et al. | 244/3.16 |
| 2,961,928 | 11/1960 | Rosenthal | 244/3.28 |
| 3,048,086 | 8/1962 | Robert et al. | 102/49.3 |
| 3,064,924 | 11/1962 | Fairbanks | 244/3.16 |
| 3,196,793 | 7/1965 | Milenkovic | 244/3.28 |
| 3,695,555 | 10/1972 | Chadwick | 244/3.16 |
| 3,712,562 | 1/1973 | Alpers | 244/3.15 |

*Primary Examiner*—Charles T. Jordan

*Attorney, Agent, or Firm*—Edward B. Johnson

[57] ABSTRACT

A clustered munition in a system for low altitude aerial delivery, which releases multiple rocket powered missiles, each having the capability to cruise at a constant altitude and search for a target. Once a target is identified, the missile homes on and strikes the target. In the preferred form the target seeking means is a radiometric seeker operating in the millimeter wavelength range, in which metal or similarly reflective targets stand out against the background and provide a significant signal which is used to program the terminal action of the missile.

4 Claims, 14 Drawing Figures

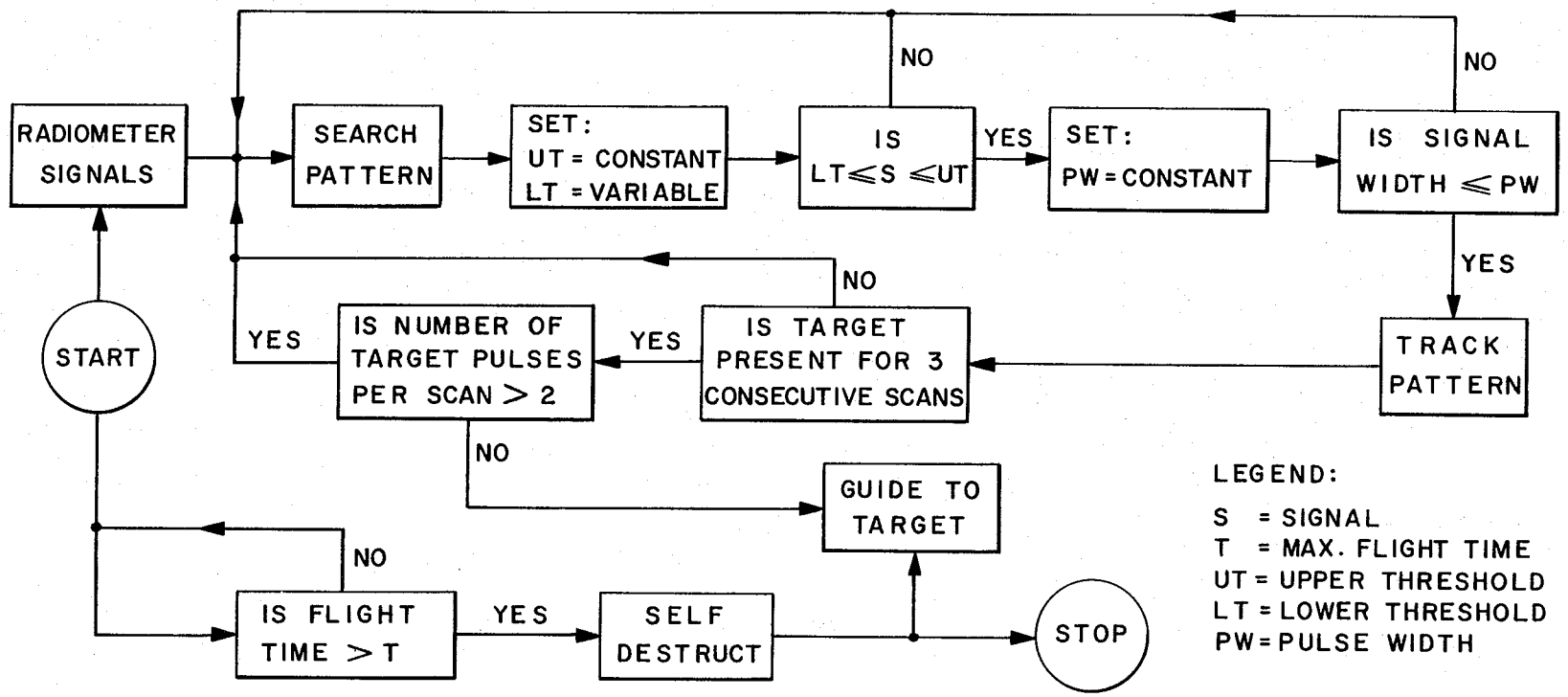
Fig. 9
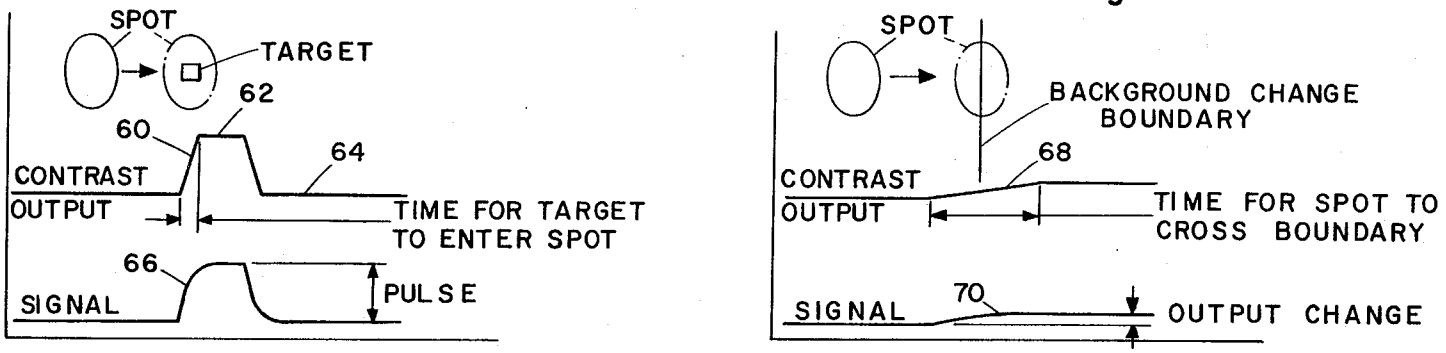
Fig. 10
Fig. 11

MULTIPLE TARGET SEEKING CLUSTERED MUNITION AND SYSTEM

BACKGROUND OF THE INVENTION

Clustered munitions have been used to deliver a variety of small weapons which are separated in an air burst to cover a wide target area. The individual weapons known as submunitions are usually bomblets, pyrotechnic devices, or the like, but do not have individual guidance to selected targets, the cluster technique being used primarily for area saturation of a target. Guidance systems have been utilized in some recent submunitions but the designs of these weapons have not included effective wing surfaces nor any propulsion means. Such lack requires that the seeker ranges be excussive and the area of coverage small. Guided weapons are usually individually launched and carry a large warhead, since the complexity and cost of the guidance system makes it impractical for large numbers of small missiles.

Targets such as tanks or other armored vehicles are not easily damaged by randomly scattered small munitions. However, if a direct hit can be made, a small shaped charge of explosive can destroy or incapacitate a tank. In an attack on a group of armored vehicles it would be a distinct advantage to use multiple small missiles capable of homing on individual targets, while keeping the unit cost to a minimum.

SUMMARY OF THE INVENTION

In the weapons system described herein, a delivery canister or other appropriate holder contains or holds a cluster of small rocket propelled missiles, which are normally stored with aerodynamic surfaces folded. The canister, for example, is launched from an aircraft at low altitude, preferably by a lofting maneuver which enables the aircraft to stay clear of the target area. At a predetermined altitude the canister bursts and the missiles fall free. The aerodynamic surfaces extend and the missiles level out at a preset cruise altitude, controlled by a simple aneroid device in each missile. The missiles are propelled toward the target area each having a simple seeker system for detecting a target. It has been found that a radiometric detector operating in the millimeter wavelength band, at 35 GHz for example, can detect a metal or similarly reflective target against the terrain background. When a target is identified by signal discrimination the scanning antenna of the radiometric seeker system is driven in a tracking pattern which enables the missile to be steered to a direct hit on the target. A small shaped charge warhead carried in the missile is thus delivered in the most effective manner for destroying the target.

The primary object of this invention, therefore, is to provide a new and improved multiple target seeking clustered munition adapted for aerial delivery at a safe distance from the target.

Another object of this invention is to provide a multiple target seeking clustered munition in which the individual munitions have means for detecting and homing on a target.

Still another object of this invention is to provide a new and improved multiple target seeking clustered munition which, with its versatility of operation, is simple and low in cost. Other objects and advantages will be apparent in the following description and with reference to the accompanying drawings, in which:

FIG. 9 is a function diagram of the target seeking and homing action.

FIG. 10 is a diagram illustrating a typical target pulse occurring in the radiometer system.

FIG. 11 is a diagram illustrating the small signal occurring from a change in background character.

DESCRIPTION OF THE PREFERRED EMBODIMENTS

Figure 1:
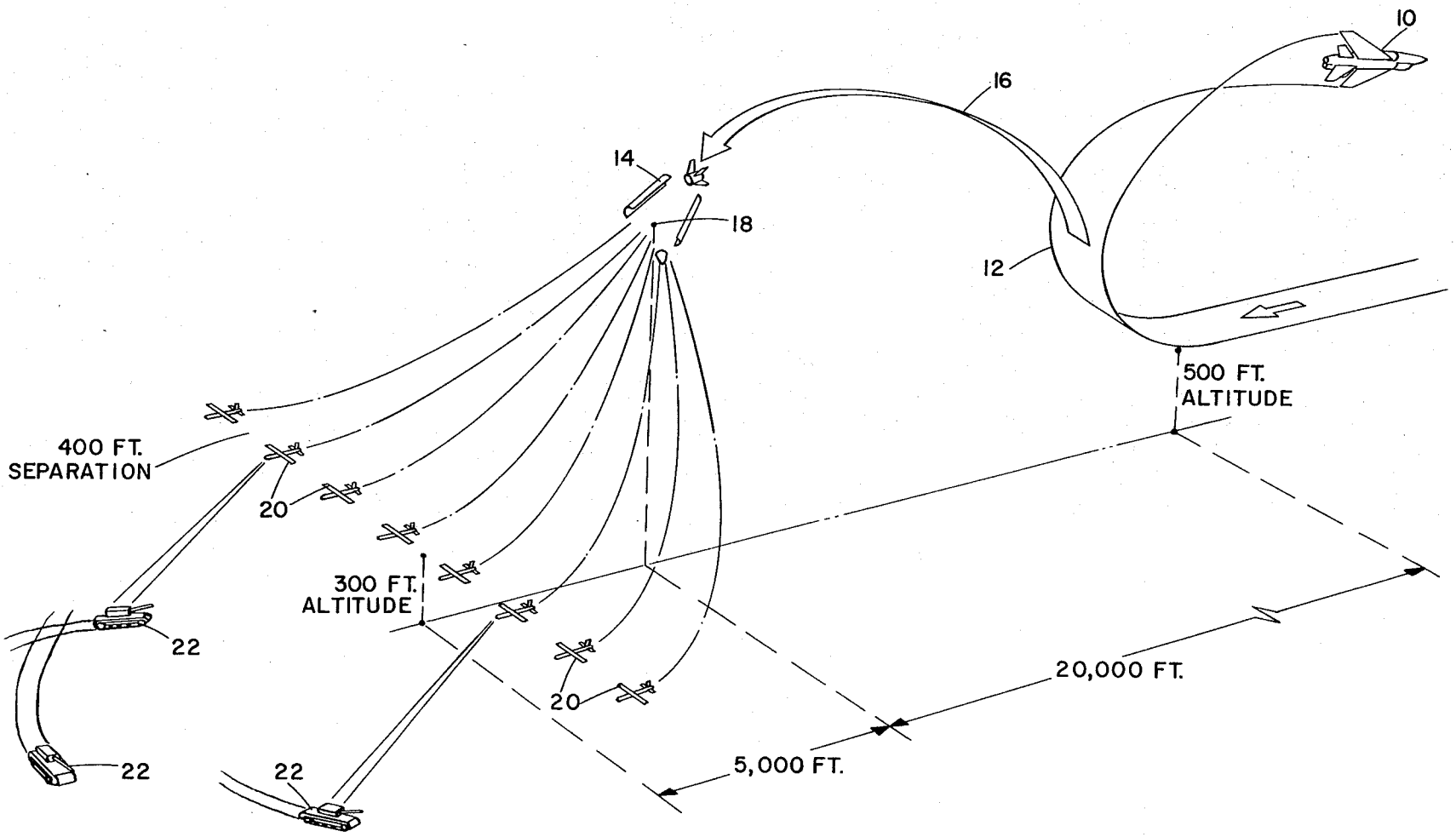
FIG. 1 is a diagram of a typical delivery operation of the clustered munition.

In the typical mission illustrated in FIG. 1, an aircraft 10 flies a conventional lofting maneuver, indicated by flight path 12, to release a conveyance device, such as a canister 14, for example, which follows a ballistic path 16 to a target point 18. At the target point the canister bursts and releases a cluster of missiles 20, which are spread out across the target front by the bursting action, by aerodynamic trim or any other suitable separation means. Typically the aircraft, which could be some other type of flying vehicle, approaches at about 500 feet altitude and releases the canister about 20,000 feet from the target point, which may be from 1,000 to 1,500 feet in altitude. It should be understood that the missiles could also be clustered in or around a separable rack-like conveyance (not shown) which may have an ejectable protective cover if desired.

Figure 2:
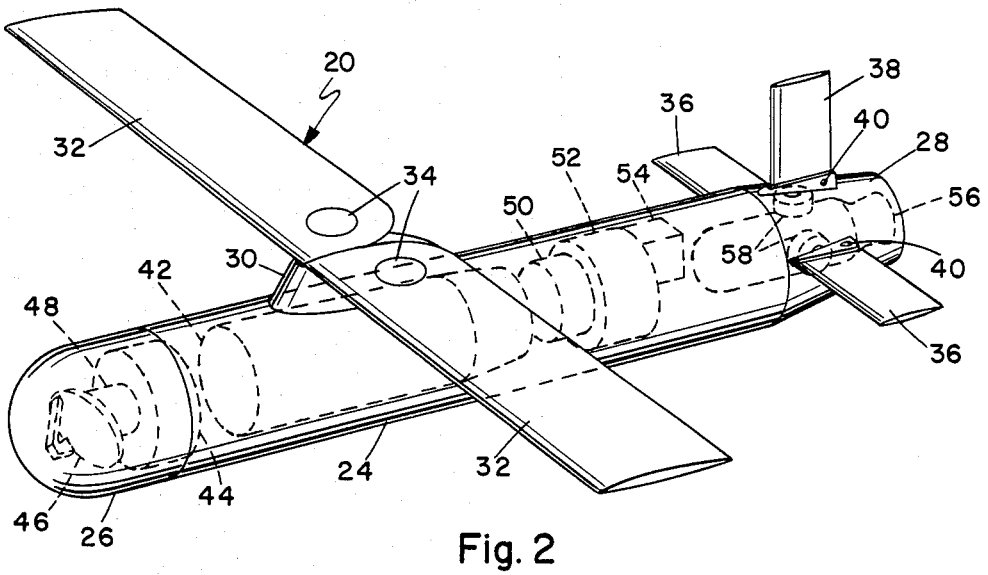
FIG. 2 is a perspective view of a typical individual missile or vehicle.
Figure 3:
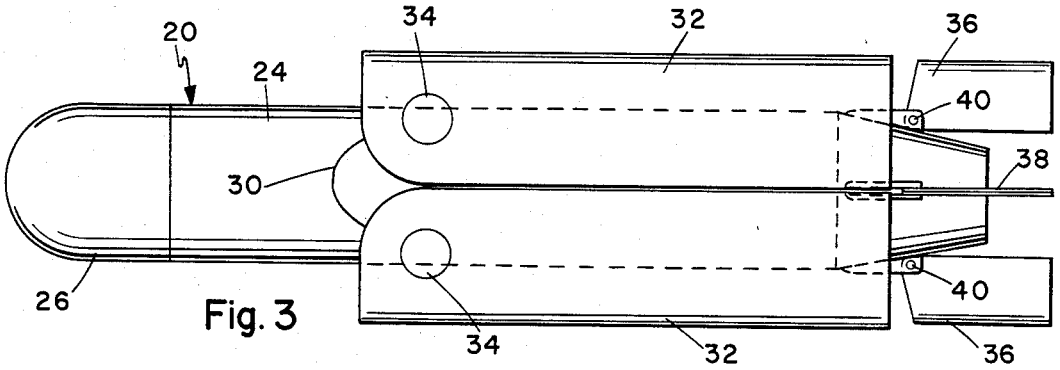
FIG. 3 is a top plan view of the missile with the aerodynamic surfaces folded.
Figure 4:
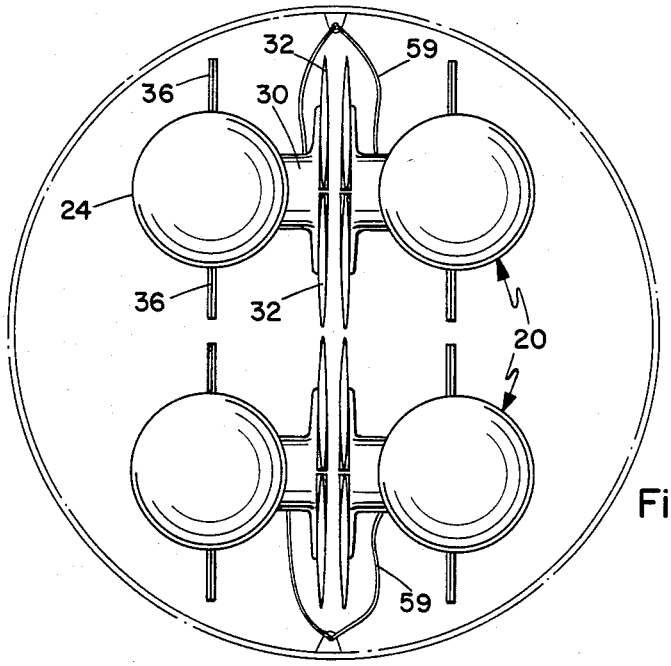
FIG. 4 is a front elevation view of four such missiles clustered for installation in a canister.

One form of the missile illustrated in FIGS. 2–4, has a generally cylindrical body 24 with a domed nose section 26 and a tapered tail section 28. Mounted on a short pylon 30 above the body 24 are wings (control surfaces) 32, hinged on pivots 34 to fold back along the body. On the tail section 28 are horizontal control surfaces 36 and a vertical control surface 38, mounted on hinges 40 to fold back. The wings and control surfaces may be extended upon release by simple springs, or by any other suitable means, self-extending aerodynamic surfaces on missiles being well known. It should be understood that none of the wings or other control surfaces need be the foldable type but some or all could be permanently fixed in the extended position, depending upon missile size, number desired, storage factors, mission requirements, etc., and the degree of complexity and sophistication involved.

In the central portion of the body is a conventional shaped charge warhead 42, actuated by a suitable crush switch or impact type detonator. The missile is guided by a radiometer 44, having an antenna 46 within nose section 26, with an antenna scanning drive 48. Behind the warhead is a battery 50 and a guidance electronics package 52, included an aneroid unit 54 or other altitude control means. In the tail section 28 is a rocket motor 56, for example, preferably capable of providing 15 to 20 seconds sustaining power. The control surfaces 36 and 38 are rotatably driven about spanwise axes by servo motors 58. It must be emphasized that by designing a missile having an airframe and control surfaces which provide a high glide ratio, the rocket motor 56 may be deleted. However, there would be a decrease in the overall range and a decrease in effectiveness, that is, the number of target encounters would be less.

As is understood by those skilled in the art, the basic techniques of scanning for and tracking a target, and controlling the flight path of a missile to intercept the target are well known. Many off-the-shelf antenna drive and vehicle guidance circuits and packages, and control servo systems, are readily available, and adaptable to the vehicle illustrated.

Upon release from the canister, the missile is activated by switching on the seeker and guidance systems. This can be accomplished by static lines or lanyards 59 tied to the canister, or by the spring erection of the aerodynamic surfaces. The aneroid unit 54 can be preset or can be set on release with reference to altitude sensing means carried in the canister, to cause the guidance package to level the missile out at the predetermined cruise altitude. At this altitude the rocket motor 56 is fired to sustain the missile in cruising flight.

Figure 5:
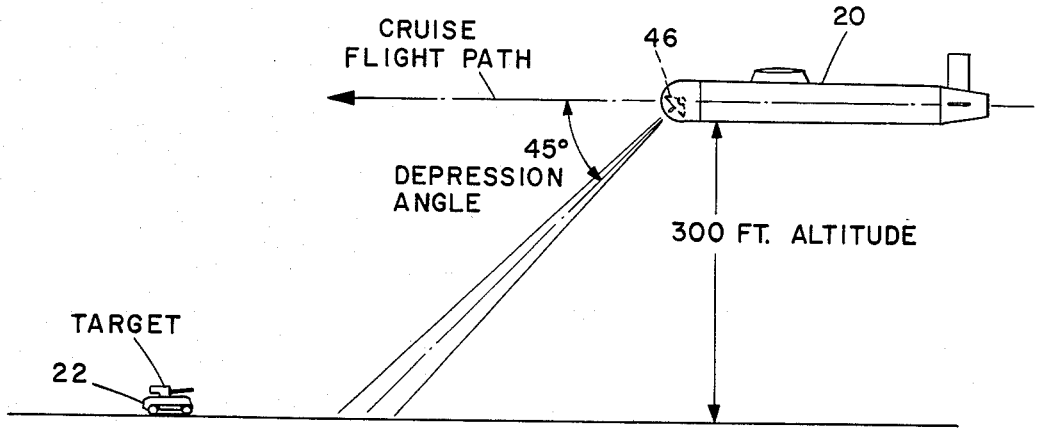
FIG. 5 is a diagram, in side elevation, of the cruise mode of the target seeking missile.

During the cruise portion of the flight, the antenna 46 is directed at 45 degrees, for example, downwardly from the longitudinal axis of the missile, as indicated in FIG. 5, and is swept from side to side by the drive means 48 to produce the scan search pattern, the beam spot traverses a forwardly progressing arcuate path which sweeps the terrain ahead of the missile. When a target 22 is detected, the antenna scan is switched to an identification and track pattern centered on the target, as in FIG. 7, producing a signal pulse each time the beam crosses the target 22. The missile is then controlled by the guidance system to home on the target. From the cruise altitude indicated and the relative position of the missile to the target due to the initial look-down angle, the missile will impact the target from a near vertical approach.

The radiometer 44 is essentially a passive receiver of well known circuitry, sensitive to energy in a millimeter waveband. A frequency of 35 GHz has been found particularly suitable. The receiver in solid state form is small enough to permit mounting directly on the antenna 46, thus eliminating flexible waveguides. One form of millimeter wave radiometer 44 uses a millimeter wave oscillator or added into the radiometer circuitry whereby the radiometer functions as an active radiometer. The added illuminator utilizes a silicon IMPATT type diode, for example, in an adjustable holder. A Cassegrainian antenna having a rotating secondary reflector is connected to the illuminator and to a transmit-receive switch (which is preferably a PIN diode switch) through a duplexer, which may be a ferrite circulator. A balanced mixer is connected to the output of the switch and to a local oscillator operating with a Gunn type diode, for example. The mixer output is fed to an IF/video amplifier whose output in turn is fed to a tracking circuit having a range gate. The tracking circuit accepts video and timing reference pulses and delivers detected scan modulation and a dc acquisition indicator voltage to a gimbal servo control circuit. The servo control circuit controls the position and motion of the gimbaled antenna during search and track modes. The antenna mount is a two-axis direct drive gimbal, powered by two dc torque motors. Potentiometers mounted within the motor housings provide closure of the servo loops. A modulator/synchronizer circuit network is connected to the illuminator, the switch and to the tracking circuit. The modulator/synchronizer circuit performs three functions. It generates a train of rectangular pulses that controls the illuminator output waveform, it protects the mixer against power overload by turning off the switch for the duration of each transmitted pulse of energy and it sends synchronizing pulses to the tracking circuit to control the start of each range sweep.

In the millimeter wavelength region, terrain background, being effectively a lossy dielectric, has an average radiometric "temperature" of about 280° K. A metal target, such as a tank, reflects a sky temperature of about 50° K. The sky temperature actually varies with reflectivity of the target and the angle of reflection from the zenith, but the generalized figures indicate the large difference which facilitates picking a target out of the background. Certain backgrounds such as asphalt, and water in particular have effective temperatures which differ from the background average. However, by selective filtering the radiometer can be made sensitive to the particular target signal range required.

In FIG. 10, the beam spot is represented as passing over a target. The reflectivity will undergo a sharp change as the target enters the beam spot, as indicated by leading edge slope 60, the reflectivity remaining at a peak value 62 while the target is within the spot and returning to nominal background value 64 as the spot passes beyond the target. The resultant radiometer signal pulse 66 is sufficient to trigger recognition circuitry.

In FIG. 11 a more gradual change 68 in reflectivity is indicated as the beam spot passes through one terrain type to another, such as from rocks to heavy brush. The resultant signal change 70 is small and the output remains at the new level until the beam encounters another change in terrain. Such changes do not affect the radiometer output sufficiently to initiate any action. It will be obvious that there will also be fluctuations in the signal due to irregularities in the terrain being scanned, but these will not normally be sufficient to trigger a reaction.

Figure 6:
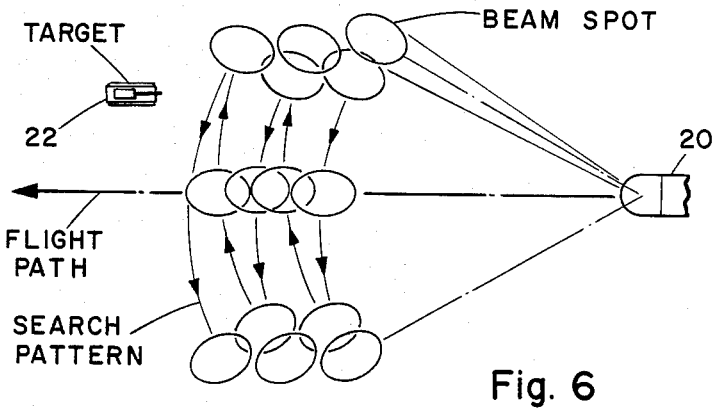
FIG. 6 is a diagram from above, illustrating the scanning pattern of the seeker means.
Figure 8:
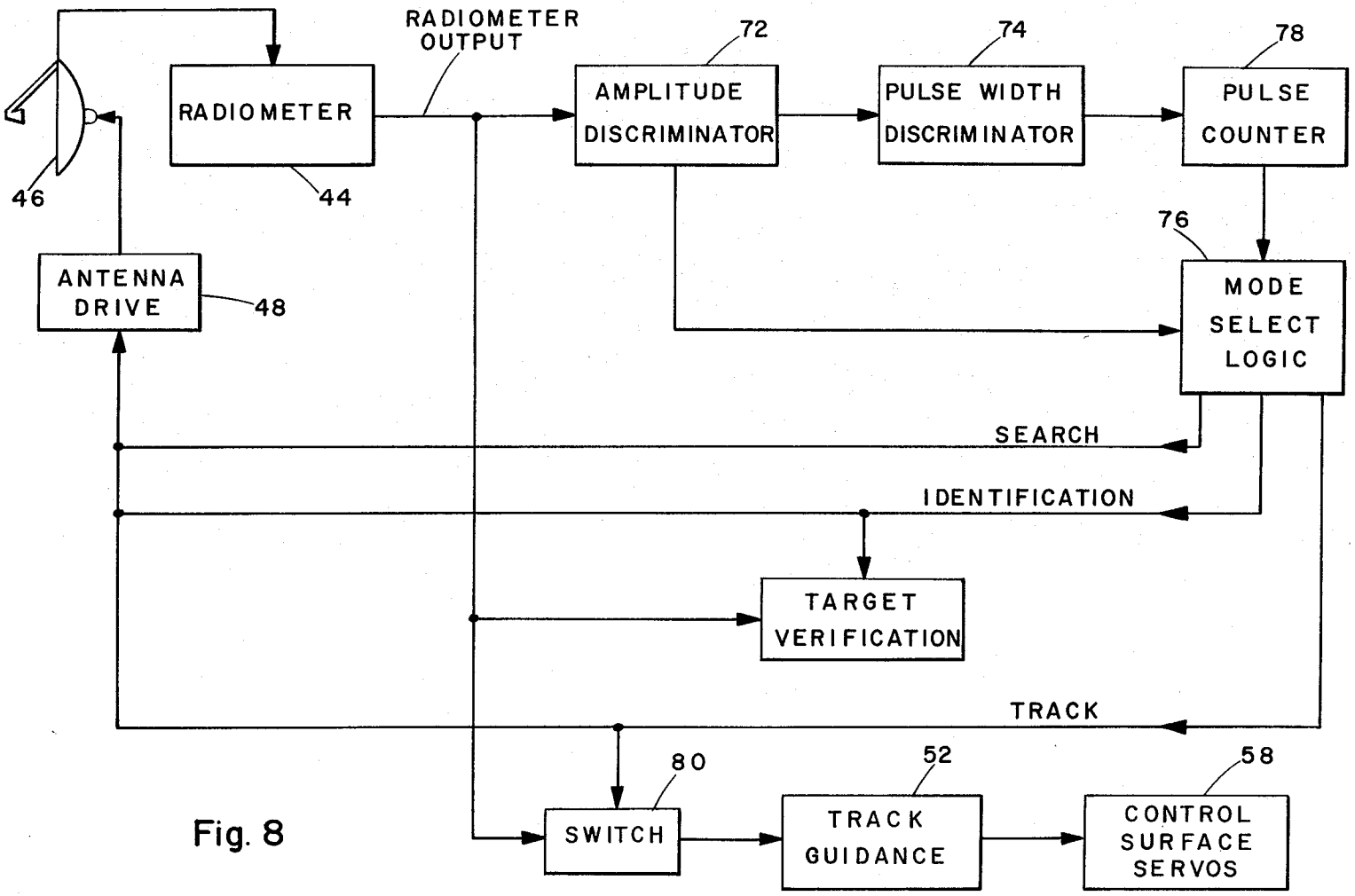
FIG. 8 is a block diagram of a radiometer seeker system.

Referring now to FIG. 8, the output of the radiometer 44 is fed to an amplitude discriminator 72, which determines when a sufficient amplitude change occurs to suggest a target. The amplitude discriminator provides a signal to a pulse width discriminator 74 and to a mode selector logic circuit 76. A pulse counter 78 is connected to the pulse width discriminator 74 and provides a second signal to the mode select logic circuit 76. When no significant changes are occurring in the radiometer output, the mode select logic commands the antenna drive 48 to operate in the search mode, with the sweeping action of FIG. 6.

Figure 7:
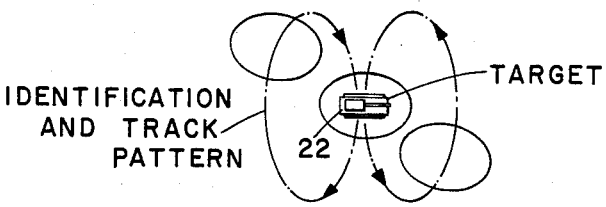
FIG. 7 is a diagram of the scanning pattern in the tracking and homing mode.

If a pulse of sufficient amplitude is received, the mode select logic switches to an identification mode and commands the antenna drive 48 to operate in the identification and track pattern of FIG. 7. If the pulse width and number of pulses meet the predetermined requirements, the mode select logic switches to track mode. The antenna scan pattern continues in the same type pattern, but switch 80 is actuated to start the track guidance package 52, which controls servos 58 to guide the missile to the target. If the pulse width and number of pulses do not meet requirements, the mode select logic reverts to the search mode to continue target seeking.

The functions involved in the operation are diagrammed in FIG. 9. At the start the radiometer signals are those received from the search pattern scan. In the amplitude discrimination circuit an upper threshold (UT) is set at a constant and the lower threshold of pulse amplitude is variable. This allows processing small signals which may be of interest, such as received from grazing contact of the beam with a target. If the signal (S) is within limits equal to or greater than the lower threshold and equal to or less than the upper threshold, the signal is passed to the pulse width circuitry. If the signal is not within the set amplitude limits, the search pattern continues.

In the pulse width circuitry based on the known scanning speed and the average width of a target of interest, which avoids reaction to a significant pulse from a wide target such as a body of water. If the signal pulse width is equal to or less than the preset pulse width (PW) the track pattern is initiated. If the pulse width is equal to or greater than the preset value, the search pattern continues. The pulse counter now determines if the target signal is present for three consecutive scans, to ensure that the target is within the effective strike zone of the missile. If not the search pattern is resumed. If the target signal is present as required, the pulse counter determines how many times the pulse occurs in each side to side scan. If the number is more than two, as from multiple targets which could cause indecision and a miss, the search pattern is resumed. If, however, the number of target pulses is not more than two per scan, the guidance to the target is initiated.

Also in the circuitry is a flight timer which is set to a time sufficient to allow the missile to reach a target within the range of its propulsion means. The timer is activated at the start of the function sequence and, when the preset time is reached, the missile is commanded to self destruct by any suitable means.

Figure 12:
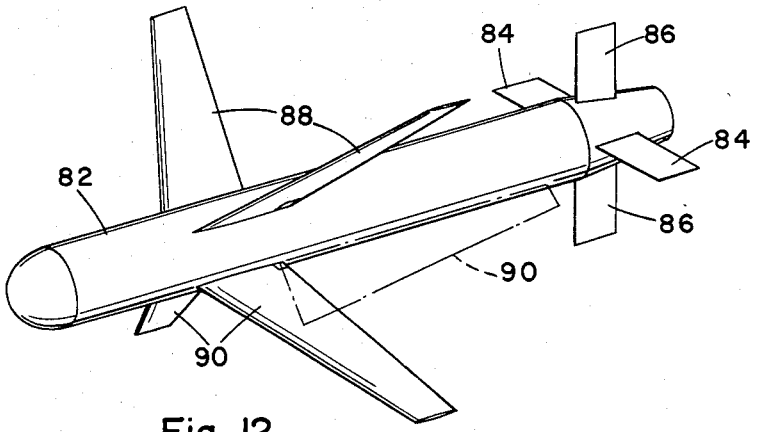
FIG. 12 is a perspective view of an alternative missile configuration.

An alternative missile configuration, particularly suitable for high speed operation, is illustrated in FIG. 12. The body 82 contains all of the equipment used in missile 20, and the tail section carries horizontal control surfaces 84 and vertical control surfaces 86 in a cruciform arrangement. The wings are also in cruciform arrangement and are offset 45 degrees in rotation from the tail surfaces, all the surfaces being foldable. In flight the upper pair of wings 88 would be extended for cruising, the lower wings 90 being folded as indicated in broken line. Upon initiation of final tracking on a target, the lower wings would be extended, making the missile aerodynamically symmetrical to simplify directional control in the final approach to the target.

Figure 13:
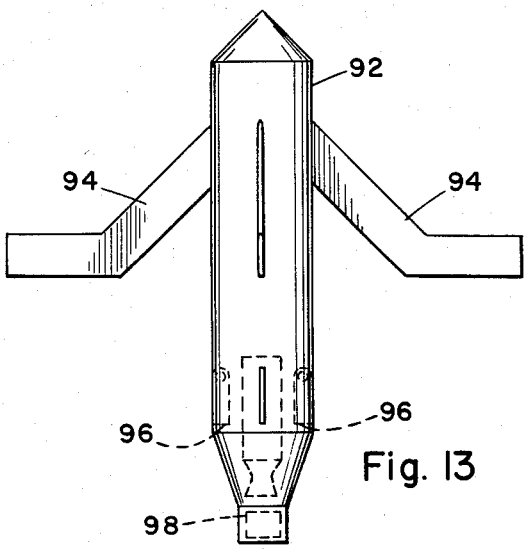
FIG. 13 is a side elevation view of a further missile type for delayed target detection after delivery.
Figure 14:
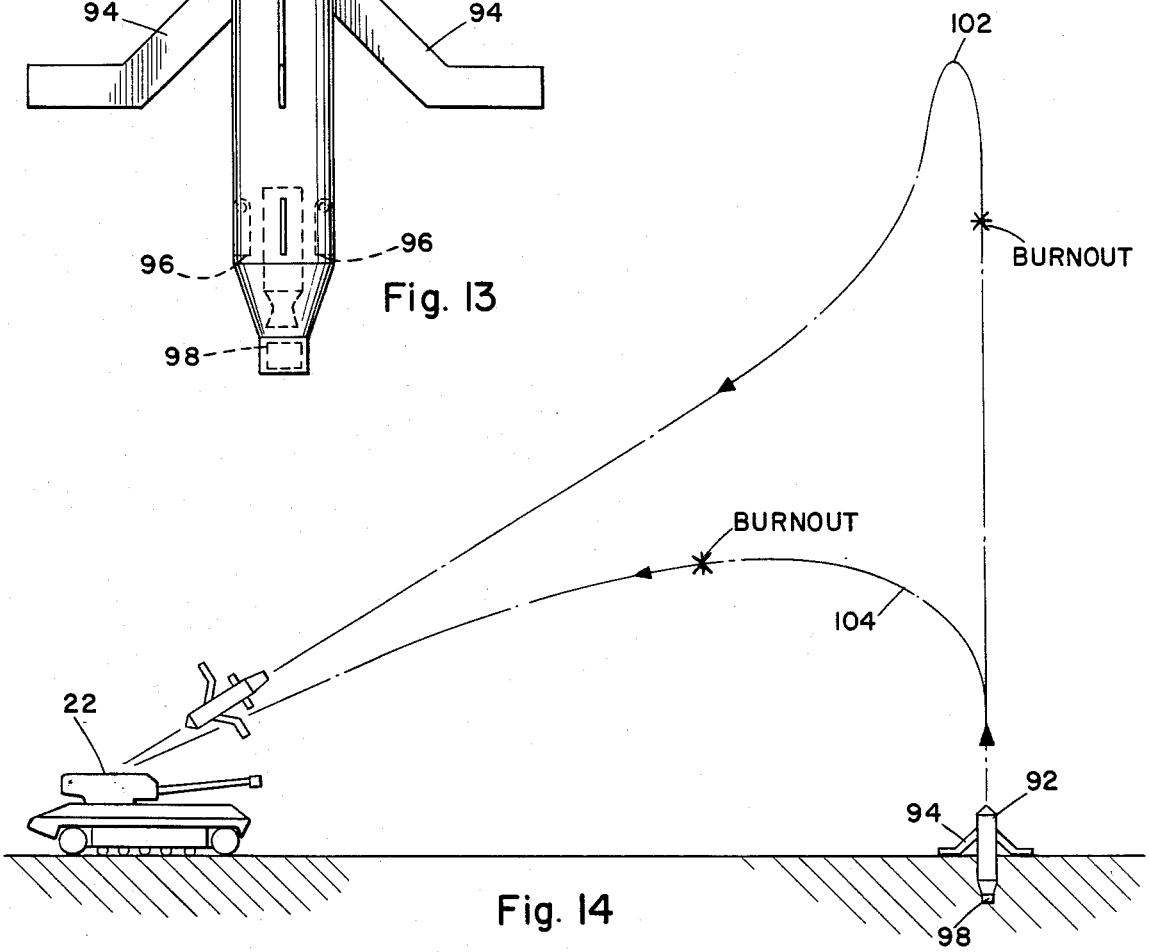
FIG. 14 is a diagram of the operation of the missile shown in FIG. 13.

A further missile configuration is illustrated in FIGS. 13 and 14. The body 92 again contains all of the equipment as described above. Wings 94 are shown extended and the tail surfaces 96 retracted, in which configuration the vehicle is implanted vertically nose up in the ground. The missile can be air dropped or may be manually implanted in an area known to be frequented by target vehicles. The extended wings act as stabilizing means to support the missile.

At the base of the body is a sensor 98, which may be of a seismic type to detect vibrations of an approaching target 22. Acoustic, thermal, or other such sensors may also be used at appropriate positions on the missile. When an approaching target is detected, the rocket motor 100 is fired to propel the missile upwardly until burnout of the motor. The missile will then turn over at the peak 102 of the flight path, stabilized by the now extended tail surfaces, so that the seeker system can detect and home on the target.

If the missile is equipped with a more sophisticated guidance system, such as inertial type guidance, the missile may be programmed to a lower and faster flight path 104. At the close range at which the missile attacks the target, other seeker or sensor means may be suitable such as acoustic or thermal types.

The missile system is thus primarily effective against a dispersed group of targets and is delivered by an aircraft from a safe distance. The missiles seek out individual targets with simple detection and guidance means and attack from above on the vulnerable portions of the targets.

Having described our invention, we now claim:

1. A multiple target seeking clustered munition system, comprising:

a plurality of target seeking missiles arranged in a cluster, each of said missiles having a body with aerodynamic sustaining and controlling surfaces mounted thereon;

conveyance means for holding and carrying said clustered missiles, and including means for releasing the missiles therefrom in the vicinity of a target;

target seeking means operably mounted in said missile body, the target seeking means including a receiver sensitive to radiation from a target and its surroundings, and having means for identifying the target against the background;

a receiving antenna coupled to said receiver;

drive means for driving the antenna in a search scan pattern, and being responsive to signals from the target seeking means to drive the antenna in a target tracking scan upon identification of a target;

target identification means having pulse amplitude and pulse width discriminating means for identifying a target signal pulse in a background signal of different and substantially constant level, and including pulse counting means for determining the number of target pulses in each scan of the antenna;

propulsion means operably mounted in said missile body for propelling said missile in cruising flight after release from the conveyance means;

a warhead operably mounted in said missile body;

and guidance means coupled to said controlling surfaces, said guidance means being responsive to signals from said target seeking means to guide said missile in cruising flight and, upon identification of a target, to operate said controlling surfaces and guide the missile to the target.

2. A multiple target seeking clustered munition system according to claim 1, wherein said guidance means is responsive to a predetermined combination of pulse amplitude, pulse width and pulse count to guide the missile to the target.

3. A multiple target seeking clustered munition system according to claim 2, wherein said receiver is a radiometric receiver having an effective frequency on the order of 35 GHz.

4. A multiple target seeking clustered munition system according to claim 1, and including altitude sensing means coupled to said guidance means for holding the missile at a predetermined cruising altitude.

* * * * *